US008608531B1

(12) United States Patent
Huang

(10) Patent No.: US 8,608,531 B1
(45) Date of Patent: Dec. 17, 2013

(54) ARROW PREPARATION SYSTEM

(76) Inventor: Dorge O. Huang, Henry, IL (US)

( * ) Notice: Subject to any disclaimer, the term of this patent is extended or adjusted under 35 U.S.C. 154(b) by 154 days.

(21) Appl. No.: 13/412,699

(22) Filed: Mar. 6, 2012

(51) Int. Cl.
*B24B 41/06* (2012.01)
*B23F 21/03* (2006.01)

(52) U.S. Cl.
USPC ..... 451/386; 451/391; 451/397; 451/552; 451/555

(58) Field of Classification Search
USPC ..... 451/365, 386, 391, 397, 404, 539, 552, 451/555
See application file for complete search history.

(56) References Cited

U.S. PATENT DOCUMENTS 547,151 A * 10/1895 Moseley ..... 144/28.9
740,962 A * 10/1903 Wilcox ..... 144/28.1
1,192,416 A * 7/1916 Graves ..... 451/370
1,221,556 A * 4/1917 McEachron ..... 451/370
1,411,713 A * 4/1922 Downing ..... 451/320
2,370,908 A * 3/1945 Llorens ..... 451/378
4,001,982 A * 1/1977 Griffin et al. ..... 451/552
4,069,528 A * 1/1978 Newton et al. ..... 7/170
4,078,455 A * 3/1978 Brody ..... 76/88
4,217,735 A * 8/1980 McGeoch et al. ..... 451/321
4,594,782 A * 6/1986 Willard ..... 30/494
5,199,224 A * 4/1993 Aluotto ..... 451/320
5,582,542 A * 12/1996 Stein ..... 451/367
5,644,853 A * 7/1997 Dixon ..... 33/506
5,810,649 A * 9/1998 Oar et al. ..... 451/378
6,306,051 B1 * 10/2001 Stockhamer ..... 473/569
6,602,143 B2 * 8/2003 Pettigrew ..... 473/1
7,013,772 B1 * 3/2006 Grace et al. ..... 82/1.11
8,231,429 B2 * 7/2012 Hildebrand et al. ..... 451/6

* cited by examiner

*Primary Examiner* — Eileen P. Morgan
(74) *Attorney, Agent, or Firm* — Donald J. Ersler

(57) ABSTRACT

An arrow preparation system preferably includes a lengthwise base, at least two arrow supports and a grinding member. The lengthwise base preferably includes a pair opposing rails for slidably retaining the at least two arrow supports and the grinding member. Each arrow support preferably includes a support slidable base, a pair of roller bearings, an anchor pin and a knurled nut. The knurled nut is secured to anchor pin and threadably retained in the support slidable base. The pair of roller bearings are rotatably retained on a top of the support slidable base to support an arrow shaft. The grinding member preferably includes a slidable grinding base, the anchor pin and the knurled nut. The slidable grinding base includes a vertical grinding face. A piece of self-sticking sandpaper is applied to the vertical grinding face. The knurled nut and anchor pin and threadably retained in the slidable grinding base.

6 Claims, 3 Drawing Sheets

ARROW PREPARATION SYSTEM

BACKGROUND OF THE INVENTION

1. Field of the Invention

The present invention relates generally to archery and more specifically to an arrow preparation system, which allows an end of an arrow to be squared with better precision than that of the prior art.

2. Discussion of the Prior Art

It appears that the prior art does not disclose an arrow preparation system for squaring the ends of an arrow shaft, which includes at least two lengthwise adjustable arrow supports for supporting a length of an arrow shaft and/or a pair of roller bearings for supporting the arrow shaft, while it is rotated for grinding the ends thereof.

Accordingly, there is a clearly felt need in the art for an arrow preparation system, which includes at least two lengthwise adjustable arrow supports for supporting a length of an arrow shaft and/or a pair of roller bearings for supporting the arrow shaft, while thereof is rotated for grinding the ends thereof.

SUMMARY OF THE INVENTION

The present invention provides arrow preparation system, which allows an end of an arrow to be squared at both ends with better precision than that of the prior art. The arrow preparation system preferably includes a lengthwise base, at least two arrow supports and a grinding member. The lengthwise base preferably includes a pair opposing rails for slidably retaining the at least two arrow supports and the grinding member. Each adjustable arrow support preferably includes a support slidable base, a pair of roller bearings, an anchor pin and a knurled nut. The support slidable base includes a pair of opposing rail slots formed in sides thereof to slidably receive the pair of opposing rails. A nut opening is formed through the support slidable base to provide clearance for the knurled nut. An anchor pin tap is formed through a bottom of the support slidable base to threadably receive a bottom threaded portion of the anchor pin. An anchor hole is formed in a top portion of the support slidable base to rotatably retain a top portion of the anchor pin. The pair of roller bearings are rotatably retained on a top of the support slidable base, such that an arrow shaft is substantially centered relative to a width of the support slidable base.

The grinding member preferably includes a slidable grinding base, the anchor pin and the knurled nut. The slidable grinding base includes a vertical grinding face. A piece of self-sticking sandpaper is applied to the vertical grinding face. A pair of opposing rail slots are formed in opposing sides of the slidable grinding base to slidably receive two opposing rails. A nut opening is formed through the slidable grinding base to provide clearance for the knurled nut. An anchor pin tap is formed through a bottom of the slidable grinding base to threadably receive a bottom threaded portion of the anchor pin. An anchor hole is formed in a top portion of the slidable grinding base to rotatably retain a top portion of the anchor pin.

In use, the at least two support slidable bases are positioned to support the arrow shaft. The grinder member is slid to contact an end of the arrow shaft. The arrow shaft is rotated to square each end thereof. The roller bearings reduce flexing of the arrow shaft during rotation.

Accordingly, it is an object of the present invention to provide an arrow preparation system, which allows an end of an arrow to be squared at both ends with better precision than that of the prior art.

These and additional objects, advantages, features and benefits of the present invention will become apparent from the following specification.

DETAILED DESCRIPTION OF THE PREFERRED EMBODIMENTS

Figure 1:
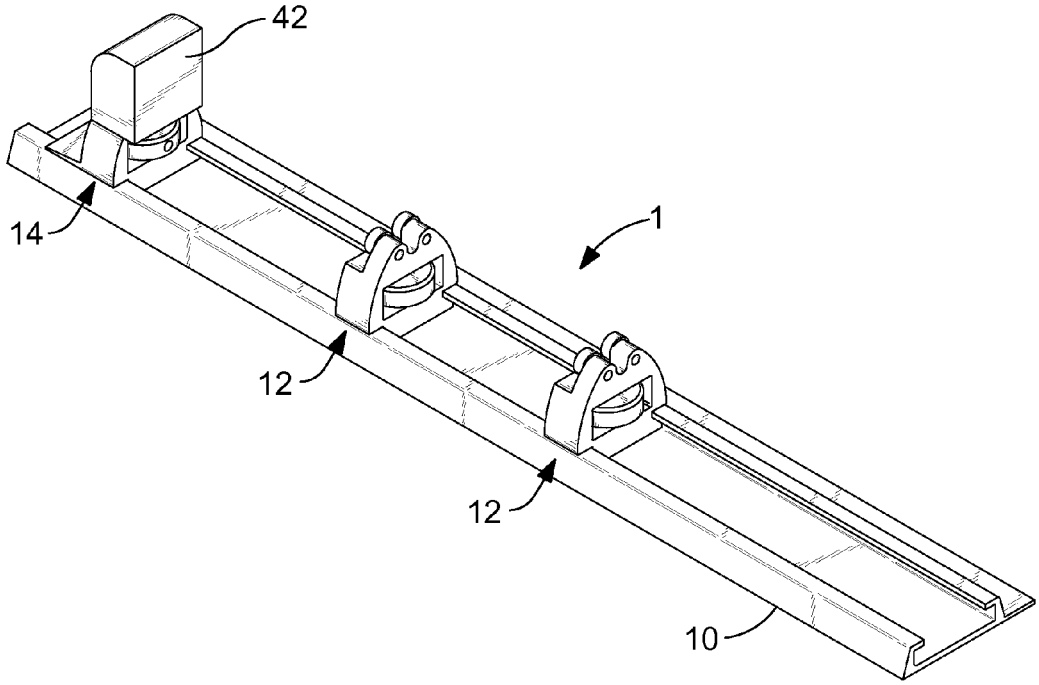
FIG. 1 is a perspective view of an arrow preparation system in accordance with the present invention.
Figure 2:
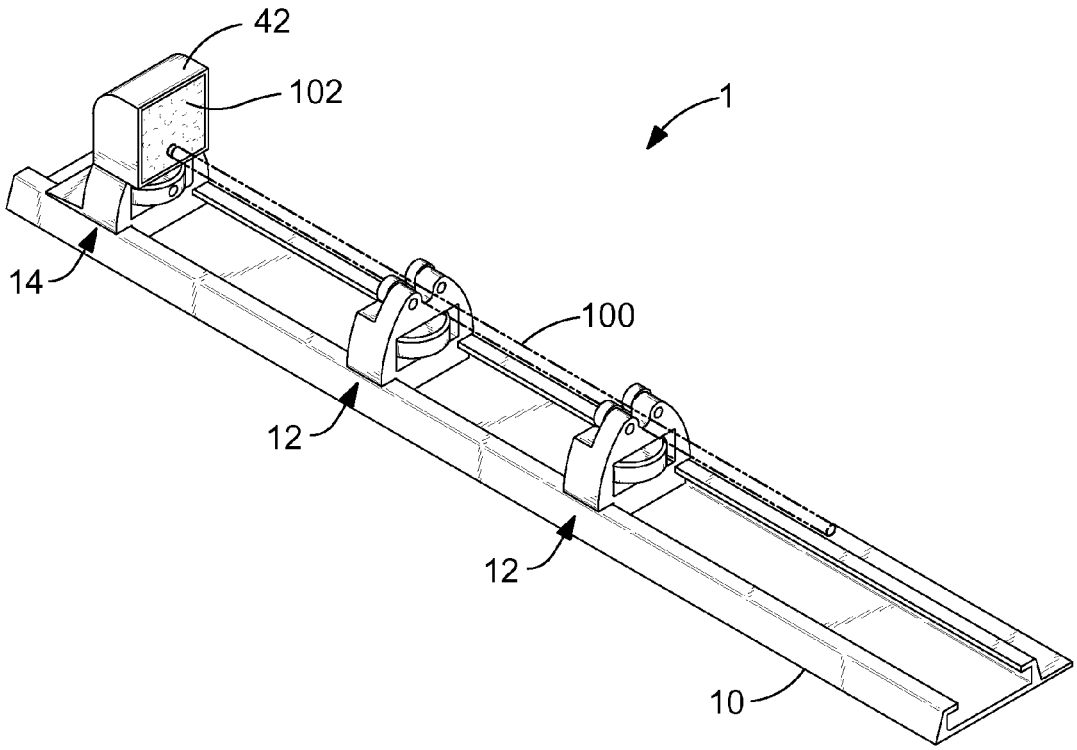
FIG. 2 is a perspective view of an arrow preparation system with an arrow placed thereupon in accordance with the present invention.
Figure 3:
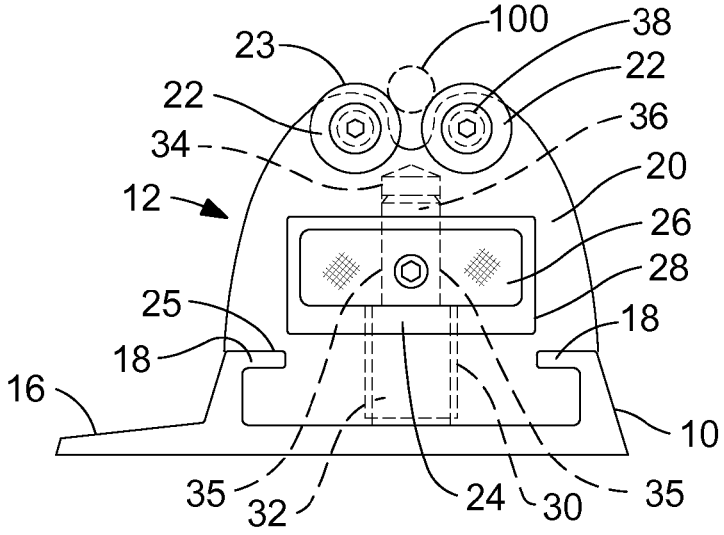
FIG. 3 is an end view of an arrow support of an arrow preparation system in accordance with the present invention.
Figure 4:
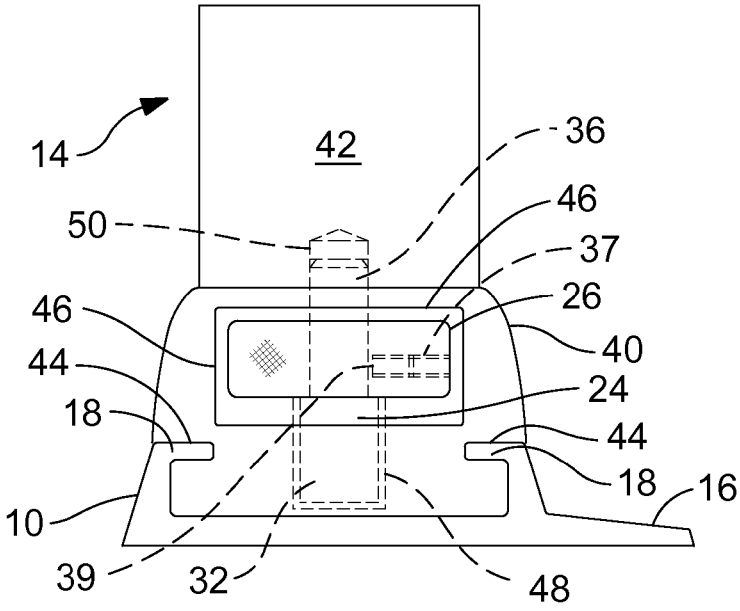
FIG. 4 is an end view of a grinding member of an arrow preparation system in accordance with the present invention.

With reference now to the drawings, and particularly to FIG. 1, there is shown a perspective view of an arrow preparation system 1. With reference to FIGS. 2-4, the arrow preparation system 1 preferably includes a lengthwise base 10, at least two arrow supports 12 and a grinding member 14. The lengthwise base 10 includes a base plate 16 and a pair of opposing rails 18. The pair of opposing rails 18 extend upward from a top of the base plate 16. The pair of opposing rails 16 slidably retain the at least two arrow supports 12 and the grinding member 14.

Each arrow support 12 preferably includes a support slidable base 20, a pair of roller bearings 22, an anchor pin 24 and a knurled nut 26. The support slidable base 20 preferably includes a pair of opposing rail slots 25 formed in opposing sides to slidably receive the pair of opposing rails 18. A nut opening 28 is formed through the support slidable base 20 to provide clearance for the knurled nut 26. An anchor pin tap 30 is formed through a bottom of the support slidable base 20 to threadably receive a bottom threaded portion 32 of the anchor pin 24. An anchor pin hole 34 is formed in a top portion of the support slidable base 20 to rotatably retain a top portion 36 of the anchor pin 24.

The knurled nut 26 includes an anchor pin hole 35 to receive the top portion of the 36. A set screw tap 37 is formed through the knurled nut perpendicular to the anchor pin hole 35. A set screw 39 is threadably engaged with the set screw tap 37. The set screw 39 is tightened against the top portion 36, such that the knurled nut 26 is used to rotate the anchor pin 24. However, other devices or methods besides the anchor pin 24 and the knurled nut 26 may also be used for locking a position of the arrow support 12 relative to the lengthwise base 10. The pair of roller bearings 22 are preferably rotatably retained in a top of the support slidable base 20 with a pair of shoulder bolts 38. The shoulder bolts 38 are preferably fabricated from brass to ensure smooth rotation of the pair of roller bearings 22. The pair of roller bearings 22 are preferably positioned, such that an arrow shaft 100 is substantially centered relative to a width of the support slidable base 20.

The grinding member 14 preferably includes a slidable grinding base 40, the anchor pin 24 and the knurled nut 26. The slidable grinding base 40 includes a vertical grinding face 42. The vertical grinding face 42 is preferably perpendicular to contact surfaces 23 of the roller bearings 22. A piece of self-sticking sandpaper 102 is applied to the vertical grinding face 42. The piece of self-sticking sandpaper 102 is removed, when it is used-up. A pair of opposing rail slots 44 are preferably formed in opposing sides of the slidable grinding base 40 to slidably receive the pair of opposing rails. A nut opening 46 is formed through the slidable grinding base 40 to provide clearance for the knurled nut 26. An anchor pin tap 48 is formed through a bottom of the slidable grinding base 40 to threadably receive a bottom threaded portion 32 of the anchor pin 24. An anchor pin hole 50 is formed in a top portion of the slidable grinding base 40 to rotatably retain a top portion 36 of the anchor pin 24. However, other devices or methods besides the anchor pin 24 and the knurled nut 26 may also be used for locking a position of the grinding member 14 relative to the lengthwise base 10.

In use, the at least two arrow supports 12 are positioned to support the arrow shaft 100. The self-sticking sandpaper 102 is applied to the vertical grinding face 42. The knurled nuts 26 are tightened to secure the pair of opposing rails 18 against the pair of opposing rail slots 25. The grinder member 14 is slid to contact an end of the arrow shaft 100. The knurled nut 26 is rotated to secure the pair of opposing rails 18 against the pair of opposing rail slots 44. The arrow shaft 100 is rotated to square each end thereof. The roller bearings 22 reduce flexing of the arrow shaft 100 during rotation.

A lengthwise base 10 has been disclosed with the at least two arrow supports 12 and the grinding member 14 both slidable along a length thereof. However, the at least two arrow supports 12 and the grinding member 14 could be removably attached and positioned along a length of the base plate 16 by the use of a plurality of bolts and a plurality of threaded taps formed in the base plate 16. Bolt holes would be formed through the at least two arrow supports 12 and the grinding member 14. The at least two arrow supports 12 and the grinding member 14 may be rigidly attached to the base plate 16.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An arrow preparation system comprising:

a base plate including two opposing rails extending at least substantially a length of said base plate;

a grinding member includes a flat grinding surface, said grinding surface is perpendicular to an axis of said base plate, said grinding member is slidably engaged with said two opposing rails, said grinding member includes means for securing a position of said grinding member along a length of said two opposing rails; and at least two arrow supports each having a first end and a second end, said first and second ends of said at least two arrow supports are slidably engaged with said two opposing rails, each one of said at least two arrow supports includes means for securing a position of said support along a length of said two opposing rails, wherein an arrow shaft is supported by said at least two arrow supports for grinding by said grinding member.

2. The arrow preparation system of claim 1, further comprising:

a piece of self-stick sandpaper is attached to said grinding member.

3. The arrow preparation system of claim 1, further comprising:

said means for securing a position includes an anchor pin and a knurled knob, said knurled knob is secured to said anchor pin, said anchor pin is threadably retained in said at least two arrow supports and said grinding member.

4. An arrow preparation system comprising:

a base plate including two opposing rails extending at least substantially a length of said base plate;

a grinding member includes a flat grinding surface, said grinding surface is perpendicular to an axis of said base plate, said grinding member is slidably engaged with said two opposing rails, said grinding member includes means for securing a position of said grinding member along a length of said two opposing rails; and at least two arrow supports each having a first end and a second end, a first slot is formed in said first end, a second slot is formed in said second end, said first and second slots are sized to slidably receive said two opposing rails, each one of said at least two arrow supports includes means for securing a position of said support along a length of said two opposing rails, wherein an arrow shaft is supported by said at least two arrow supports for grinding by said grinding member.

5. The arrow preparation system of claim 4, further comprising:

a piece of self-stick sandpaper is attached to said grinding member.

6. The arrow preparation system of claim 4, further comprising:

said means for securing a position includes an anchor pin and a knurled knob, said knurled knob is secured to said anchor pin, said anchor pin is threadably retained in said at least two arrow supports and said grinding member.

* * * * *